United States Patent [19]

Hanazono et al.

[11] 4,051,943

[45] Oct. 4, 1977

[54] RIBBON CARTRIDGE

[75] Inventors: Masami Hanazono; Yukio Hishida; Toshio Nakai, all of Nagoya; Tomoyoshi Watanabe, Chiryu; Takanobu Hirayama, Chita; Hideo Asakura, Kasugai, all of Japan

[73] Assignee: Brother Industries, Ltd, Nagoya, Japan

[21] Appl. No.: 641,673

[22] Filed: Dec. 17, 1975

[30] Foreign Application Priority Data

Jan. 9, 1975 Japan ..... 50-6308[U]

[51] Int. Cl.[2] ..... B41J 33/518

[52] U.S. Cl. ..... 197/151; 197/165

[58] Field of Search ..... 197/151, 165, 153

[56] References Cited

U.S. PATENT DOCUMENTS

| | | | |
|---|---|---|---|
| 2,252,075 | 8/1941 | Johnson | 197/151 |
| 3,340,989 | 9/1967 | Busch | 197/165 |
| 3,412,839 | 11/1968 | Smith et al. | 197/165 |
| 3,513,957 | 5/1970 | Ricciardi et al. | 197/151 |
| 3,658,164 | 4/1972 | Fujimoto | 197/165 |
| 3,731,781 | 5/1973 | Caudhill et al. | 197/151 |
| 3,905,465 | 9/1975 | Frechette et al. | 197/151 |

FOREIGN PATENT DOCUMENTS

| | | | |
|---|---|---|---|
| 883,818 | 12/1961 | United Kingdom | 197/151 |

*Primary Examiner*—Edgar S. Burr
*Assistant Examiner*—William Piepaz
*Attorney, Agent, or Firm*—George B. Oujevolk

[57] ABSTRACT

A ribbon cartridge for typewriters having a plurality of type bars which have the respective type fonts or characters at the top portions thereof and which are struck toward a printing point on a platen during the printing operation. The ribbon cartridge includes a pair of housings made of plastic material and a connecting arm member made of a metal strip for interconnecting the two housings. The connecting arm member has its center portion positioned in front of a type bar guide (on the side of the typist) and is formed substantially into a U-shaped opening as seen from the front side of the typewriter in order to permit the printing operation of the respective type bars. A spool for winding the printing ribbon is rotatably mounted in each housing, the spool being operatively connected in the usual manner to an ordinary ribbon drive means which is provided on the typewriter. Each one of the housings is provided with an aperture or slot to allow passage therethrough of the printing ribbon. A printing ribbon which is wound on one spool is fed through the aperture in its housing and taken up on the other spool through the aperture in the other housing.

1 Claim, 6 Drawing Figures

RIBBON CARTRIDGE

BACKGROUND OF THE INVENTION

This invention relates to a ribbon cartridge for typewriters, and more particularly to a ribbon cartridge for typewriters having a plurality of type bars.

DESCRIPTION OF THE PRIOR ART

Heretofore, a few attempts have been made to provide a ribbon cartridge for typewriters having a plurality of type bars. For example, a relatively early form of ribbon cartridge is described in H. L. Lambert U.S. Pat. No. 2,873,014 which employs a pair of separate containers each accommodating a spool for winding the printing ribbon thereon. Therefore, the two containers have to be separately set in the respective positions on the ribbon driving mechanisms. In addition, it was necessary to set the ribbon on the ribbon feed and reverse mechanism in order to reverse the feeding direction of the ribbon. Accordingly, in spite of its inherent advantages, the Lambert cartridge required troublesome efforts for a person installing the cartridge on the typewriter. A more recent development is the Carl P. Anderson U.S. Pat. No. 3,643,777 which also introduces a ribbon cartridge for typewriters, which unfortunately cannot be applied to typewriters with an ordinary ribbon drive mechanism.

OBJECTS OF THE INVENTION

It is therefore an object of the present invention to provide a ribbon cartridge for typewriters having a plurality of type bars, which has a compact construction, light weight and is easy to handle.

It is another object of the present invention to provide a ribbon cartridge which is adapted for use with the conventional ribbon drive means and ribbon feed and reverse means.

It is still another object of the present invention to provide a ribbon cartridge which has a non-rupturable rigid construction.

SUMMARY OF THE INVENTION

According to the inventive concept there is provided a ribbon cartridge for typewriters having a plurality of type bars, the ribbon cartridge includes a pair of housings and a connecting arm member interconnecting the two housings. The connecting arm member has its center portion positioned in front of a type bar guide (on the side of the typist) and is formed substantially into a U-shaped opening as seen from the front side of the typewriter in order to permit the printing operation of the respective type bars. A spool for winding the printing ribbon is rotatably mounted in each housing, the spool being operatively connected in the usual manner to an ordinary ribbon drive means which is provided on the typewriter. Each one of the housings is provided with a vertical slot aperture to allow passage therethrough of the printing ribbon. A printing ribbon which is wound on one spool is fed through the aperture in its housing and taken up on the other spool through the aperture in the other housing.

The above and other objects, features and advantages of the invention will become more apparent from the following description and appended claims, taken in conjunction with the accompanying drawings which show by way of example a preferred embodiment of the invention.

DETAILED DESCRIPTION OF THE INVENTION

Figure 1:
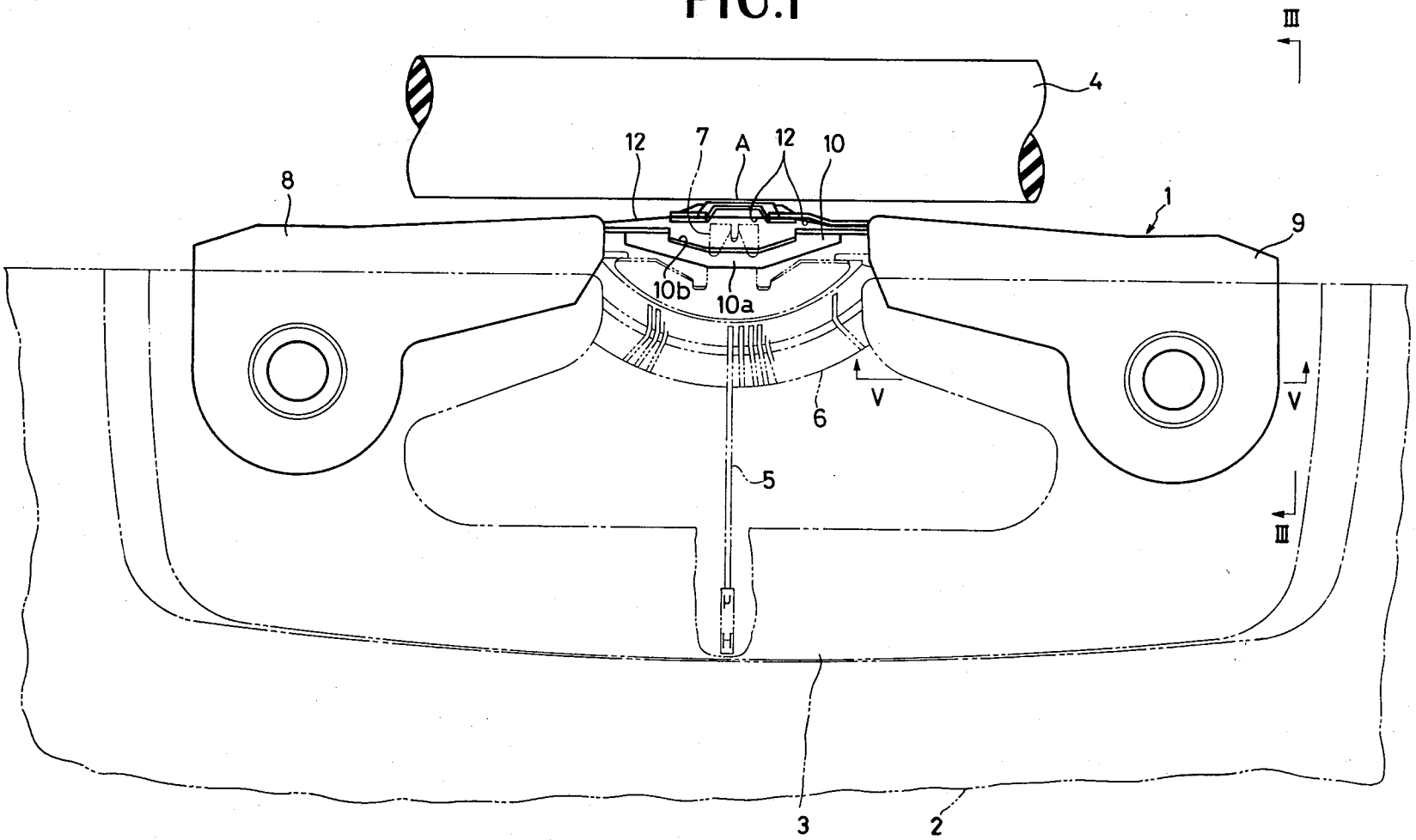
FIG. 1 is a fragmentary plan view of the ribbon cartridge of the invention which is installed on a typewriter.

FIG. 1 is a fragmentary plan view of a ribbon cartridge of the invention installed on a typewriter showing a ribbon cartridge 1, an upper cover 2 encasing the upper portion of the typewriter, and a top cover 3 mounted on the top of the upper cover 2. There is also a platen 4, and one of the type bars 5. These type bars 5 are pivotally supported on a type bar segment 6. The type bar 5 is operated by the ordinary printing operation to strike the print point A on the platen 4 with the type character which is secured at the top portion of the type bar 5, under guidance of a type bar guide 7 which is secured on the type bar segment 6.

Figure 2:
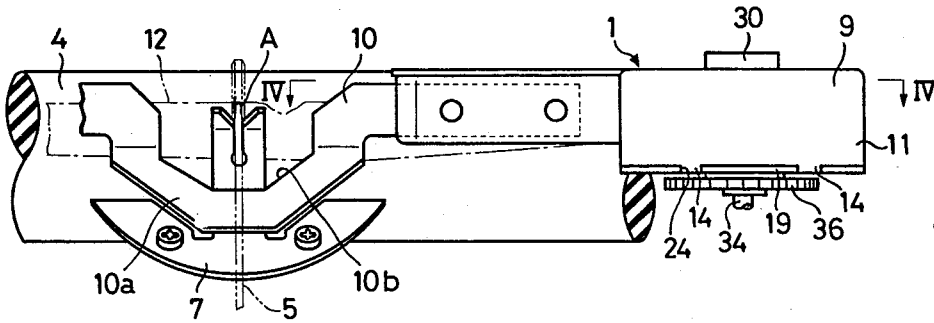
FIG. 2 is a front view showing important component parts of the cartridge.

The ribbon cartridge 1 includes a pair of housings 8 and 9, and a connecting arm member 10 which interconnects the two housings 8 and 9. The connecting arm member 10 serves to connect the housings 8 and 9 rigidly to each other and is preferably made of a metal strip which is formed substantially in U-shape in the center portion **10*a*. That is to say, the center portion 10*a* is formed with a U-shaped opening 10*b* as seen from the front side of the typewriter to avoid the print point A as illustrated particularly in FIGS. 1 and 2. The lower end of the center portion 10*a* is positioned in front of the type bar guide 7 (or toward the typist) and bent forwardly at the same angle when the cartridge is installed on the typewriter (see FIG. 3**).

Since the cartridge 1 has a symmetrical construction, only the housing 9 on the righthand will be described hereafter, omitting the descriptiion of the lefthand housing 8 for the sake of simplicity of illustration.

Figure 3:
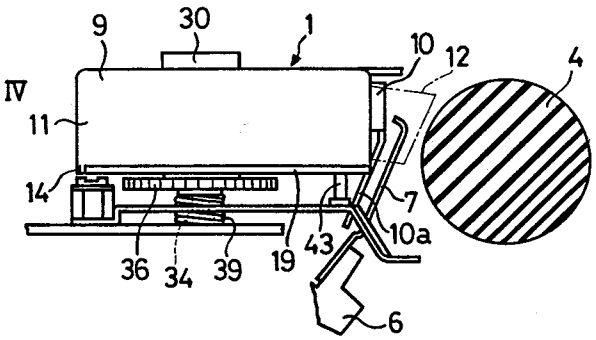
FIG. 3 is a side view seen from line III—III of FIG. 1.
Figure 4:
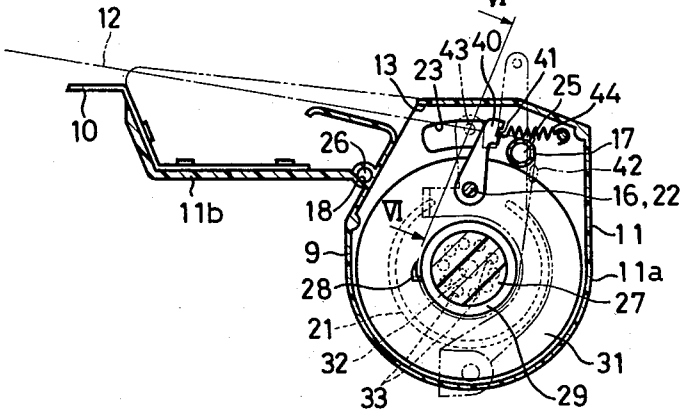
FIG. 4 is a sectional view taken on line IV—IV of FIG. 2.

The housing 9 is provided with an upper cover 11 and a bottom plate or a bottom wall 19 which are made of a suitable plastic material. The upper cover 11 includes a side wall **11*a* of substantially cylindrical form for accommodating a ribbon 12, an arm portion 11*b* extending to the left toward the print point A along the platen 4 from the side wall 11*a* as seen in the drawings, and an upper wall 11*c* covering the upper portions of the side wall 11*a* and the arm portion 11*b*. The side wall 11*a* is provided with a vertical slot aperture 13 at a position adjacent to the arm portion 11*b* for passing the ribbon 12 therethrough. The side wall 11*a* is also provided in the lower portion with a number of downward extensions 14 as seen partially in FIG. 2. The upper wall 11*c* which is located on the top of the side wall 11*a* has in its middle portion an upper aperture 15, and a hollow guide protuberance 17 for guiding the ribbon 12. As shown in FIGS. 3 and 4, the arm portion 11*b* is rigidly connected to the righthand end of the connecting arm member 10. The other or lefthand end of the connecting arm member 10 is similarly connected to the lefthand housing 8 thus interconnecting the housings 8 and 9. Indicated at 18 is a recessed aperture which is formed at the junction of the side wall 11***a* and the arm portion 11*b*.

A bottom plate or a bottom wall 19 is attached to the lower end of the side wall 11*a* of the upper cover 11 in a manner described in detail hereinafter. The bottom plate 19 has in its middle portion a bottom aperture 20 which has an arcuate protuberance 21 around the circumference thereof. An upward projection 22 is provided behind the bottom aperture 20 opposite to the projection 16 on the upper cover 11, and an arcuate opening 23 is formed around the projection 22.

The bottom plate 19 has at its circumferential marginal edge notches 24 for engagement with the downward extensions 14 of the upper cover 11, thereby determining the relative positions of the upper cover 11 and the bottom plate 19. Projections 25 and 26 are resiliently fit into the recesses of the guide protuberance 17 and the recessed aperture 18 and are disengageable therefrom to separate the upper housing cover 11 and the bottom plate 19.

A spool 27 is rotatably mounted in the housing 9 and includes a winding hub 29 which has on its circumferential surface a prong 28 for holding one end of the ribbon 12, a knob 30 which extends upwardly from the upper end of the hub 29 through the upper aperture 15 of the upper cover 11 and manually rotatable for the purpose of tensioning a loosened ribbon portion, and a flange 31 which is formed at the lower end of the hub 29 and mounted on the protuberance 21 of the bottom plate 19. The hub 29 of the spool 27 is formed with a guide hole 32 at the center of its lower end face, the guide hole 32 having arranged annularly therearound a number of small apertures 33. When the ribbon cartridge 1 is installed in position on the typewriter, fitting the guide hole 32 into the guide shaft 34, one of the small apertures 33 will automatically come into engagement with a drive pin 35 of the ribbon drive mechanism which is suitably operated during the printing operation, in a manner as will be described hereinafter. In this instance, if the spool 27 is rotated in the clockwise direction as seen in FIG. 4, the ribbon 12 is wound on the hub 29 of the spool 27.

Figure 5:
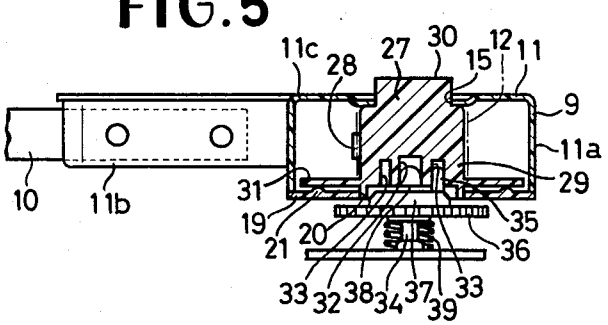
FIG. 5 is a sectional view taken on line V—V of FIG. 1.

More particularly, referring to FIG. 5, a ratchet wheel 36 which is formed with saw teeth around its circumferential edge, is rotatably mounted on the guide shaft 34 and is rotatable by an ordinary ribbon drive mechanism including feeding and holding pawls. A disc plate 37 which has an implanted upwardly projecting drive pin 35 is mounted securely on the ratchet wheel 36.

A stopper 38 is securely mounted on the guide shaft 34 to prevent the ratchet wheel 36 from escaping upwardly. A coil spring 39 is provided to urge the ratchet wheel 36 and the disc plate 37 toward the stopper 38.

In order to install the ribbon cartridge 1 on the typewriter, the guide hole 32 of the cartridge 1 is fitted on to the guide shaft 34 and the cartridge 1 is pushed downwards, whereupon the ratchet wheel 36 is pressed downward by the lower face of the spool 27 through the drive pin 35 unless the drive pin 35 fits into one of the small apertures 33 of the cartridge 1. Under these circumstances, if the typist starts typing, the ratchet wheel 36 is driven by the driving mechanism as the typing operation proceeds and the drive pin 35 comes into a position engageable with one of the small apertures 33. Upon the drive pin 35 coming into such position, it engages with one of the small apertures 33 by the action of the coil spring 39. As the spool 27 within the righthand housing 9 is driven in this manner, the printing ribbon 12 is fed toward the righthand housing 9. In this instance, the lefthand spool (not shown) which is accommodated in the lefthand housing 8 is also rotated and placed in a drivable condition. However, since one of the ribbon drive mechanisms is held in a released state in the usual manner by the ribbon feed and reverse mechanism, the printing ribbon 12 is always fed in one direction.

Figure 6:
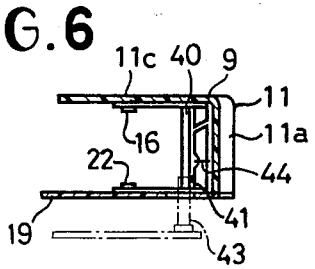
FIG. 6 is a sectional view taken on line VI—VI of FIG. 4.

The reference numeral 40 denotes an actuator which actuates the ribbon feed and reverse mechanism of the typewriter which changes the feeding direction of the ribbon 12. The actuator 40 has its one end portion pivotally mounted between the projections 16 and 22 of the upper cover 11 and the bottom plate 19 (see FIG. 6), respectively, and has at its other end portion a narrow slit 41 for passing the printing ribbon 12 therethrough. The actuator is usually biased for a clockwise direction by a spring 44 (see FIG. 4). When either one of the ribbon reverse eyelets 42 which are attached to the opposite end portions of the ribbon 12 arrives at the slit 41, the eyelet 42 and the actuator 40 are moved together to actuate the ribbon feed and reverse mechanism through a pin member 43 which is provided on the typewriter to extend through the opening 23 in the bottom plate 19. Description of the details of the ribbon feed and reverse mechanism is not given herein since it does not form any part of the subject matter of this invention.

It will be appreciated from the foregoing description that the ribbon cartridge according to the invention can be suitably applied to the conventional ribbon drive mechanisms and ribbon feed and reverse mechanisms and capable of feeding and reversing the ribbon in a secure manner, contributing to provide low cost ribbon cartridges which are easy to handle.

As the upper cover of the ribbon cartridge and the bottom plate are separable from each other, the operator can replace a used ribbon with a fresh one easily.

We claim:

1. A ribbon cartridge adapted to be removably installed on a typewriter having a plurality of type bars (5) with printing head portions, a platen (4), a type bar guide (7) to guide a type bar (5) from an at rest position to a defined print point (A) on the platen (4), a pair of ribbon drive means positioned on laterally opposite sides of said print point and driven in response to a typing action of said type bars (5), and ribbon feed and reverse means for changing the ribbon feed direction, said ribbon cartridge comprising:

a. a pair of housings (8,9) which are positionable upon each of said ribbon drive means, each of said housings including an upper wall (11*c*) having an upper aperture, an arm portion (11*b*) extending towards said print point (A), a side wall (11*a*) having a vertical slot aperture (13) to allow a ribbon to pass into said arm portion (11*b*) and a bottom wall (19) having a bottom aperture (20);

b. a ribbon spool (27) rotatably mounted in each of said housings, including pin connecting means which will be operatively connected to said ribbon drive means through said bottom aperture of said bottom wall when said housings are positioned on said ribbon drive means of said typewriter, and having a hand-operated turning knob extending upwardly through said upper aperture;

c. a ribbon wound on said ribbon spools and passing through said vertical slot apertures (13) and adapted to cross in front of said print point (A) when fed from one ribbon spool (27) to the other; said ribbon having a ribbon reverse eyelet (42) near each end portions of said ribbon;

d. a connecting arm member for connecting said two housings (8,9) made of a rigid metal strip, which has arm sections rigidly connected with said arm portions (11*b*) and has a center portion (10*a*) positioned in front of said type bar guide (7), said center portion of said connecting arm member having a U-shaped opening (10*b*) which permits the head portions of said type bars to pass through from an at rest position and strike said ribbon at said print point in a printing operation; and, e. an actuator (40) with bias means (44) pivotally mounted in each of said housings between said upper wall (11*c*) and said bottom wall (19) and usually biased for one direction, and being operatively connectable to said ribbon feed and reverse means, said actuators (40) respectively having a narrow slit (41) through which to allow passage of said ribbon, but not allow passage of said ribbon reverse eyelet (42), and said actuator (40) being rotated together with said ribbon reverse eyelet (42) in a direction away from said ribbon spool against a biasing force of said bias means (44) and actuating said ribbon feed and reverse means so as to change the ribbon feeding direction, when said ribbon is fed from one ribbon spool to the other in response to a typing action and said ribbon reverse eyelet on the side of said ribbon spool which is supplying said ribbon arrives at the slit of said actuator on the same side of said ribbon supplying spool.

* * * * *